US007764890B2

(12) United States Patent
Tsukamura et al.

(10) Patent No.: US 7,764,890 B2
(45) Date of Patent: Jul. 27, 2010

(54) IMAGE FORMING APPARATUS WITH QUICK OUTPUT MODE SETTING SECTION

(75) Inventors: Shinichi Tsukamura, Yamanashi (JP); Hiroshi Matsumoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 131 days.

(21) Appl. No.: 12/014,983

(22) Filed: Jan. 16, 2008

(65) Prior Publication Data

US 2008/0232834 A1 Sep. 25, 2008

(30) Foreign Application Priority Data

Mar. 19, 2007 (JP) ..... 2007-070302

(51) Int. Cl.
*G03G 15/00* (2006.01)
*G03G 15/20* (2006.01)

(52) U.S. Cl. ..... 399/45; 399/68; 399/69; 399/82

(58) Field of Classification Search ..... 399/67, 399/68, 69, 70, 45, 81, 82; 347/156; 219/216
See application file for complete search history.

(56) References Cited

U.S. PATENT DOCUMENTS

| | | | | |
|---|---|---|---|---|
| 6,381,422 | B1 * | 4/2002 | Tanaka | 399/45 |
| 2005/0013626 | A1 * | 1/2005 | Satoh et al. | 399/88 |
| 2007/0059009 | A1 * | 3/2007 | Nakayama | 399/69 |
| 2007/0248374 | A1 * | 10/2007 | Burger et al. | 399/82 |
| 2008/0253786 | A1 * | 10/2008 | Isobe et al. | 399/69 |

FOREIGN PATENT DOCUMENTS

| | | | |
|---|---|---|---|
| JP | 05-142884 | A * | 6/1993 |
| JP | 2001-356616 | A * | 12/2001 |
| JP | 2002-132086 | A * | 5/2002 |
| JP | 2003-66765 | | 3/2003 |

* cited by examiner

*Primary Examiner*—Sophia S Chen
(74) *Attorney, Agent, or Firm*—Cantor Colburn LLP

(57) ABSTRACT

An image forming apparatus having a short warm-up time desired by a user, wherein a quick output section is provided, and when a quick output mode is set by the quick output section, warm-up completion temperature is set to be low, and thereby, warm-up time is made to be short.

14 Claims, 7 Drawing Sheets

IMAGE FORMING APPARATUS WITH QUICK OUTPUT MODE SETTING SECTION

This application is based on Japanese Patent Application No. 2007-070302 filed on Mar. 19, 2007 in Japanese Patent Office, the entire content of which is hereby incorporated by reference.

BACKGROUND OF THE INVENTION

The present invention relates to an image forming apparatus, and in particular, to an image forming apparatus wherein an image is fixed on a recording material through heat fixing.

In an electrophotographic image forming apparatus or the like, there is commonly used a heat fixing device wherein an unfixed toner image is heated so that toner is heated and melted to be fixed on a recording material.

In the case of heat fixing, there is required a waiting time called a warm-up time that covers a period of time from the moment when a heater of the fixing device is turned on to the moment when a temperature of the heater arrives at a level for fixing, and there have been made various suggestions for shortening the warm-up time, because users wish to have a shorter waiting time.

For example, Patent Document 1 discloses a technology to lower the temperature capable of fixing to shorten the warm-up time, by lowering a speed for conveying a recording material in the fixing device, that is, a fixing speed.

In the device of the Patent Document 1, the amount of heat reduced by the reduction of the fixing temperature is compensated with the reduction of the fixing speed, resulting in advantages that a problem of insufficient fixing is mitigated considerably, and an effect of reduction of the warm-up time is obtained sufficiently.

However, the device of the Patent Document 1 has the following problems.

When the fixing speed, namely, the conveyance speed for a recording material in the fixing device is lowered in conformity to the method of the Patent Document 1, copying time is made longer by the reduction of the fixing speed and the time required for copying grows longer, and efficiency is lowered on the contrary, when the number of copies is large, although the time required for copying is shortened by the reduction of the warm-up time when the number of copies is small.

The foregoing will be described as follows, referring to FIG. 1.

When ten (10) copies are made under the condition of warm-up (hereinafter referred to as WP) reduction, the time required for copying is WP1+10CP1 as shown in FIG. 1(*a*).

Under the condition of regular WP, the time required for copying is WP2+10CP2 as shown in FIG. 1(*b*), and the expression (WP1+10CP1)<(WP2+10CP2) holds because WP1 is shorter than WP2, thus, the time required for copying is shortened by shortening of WP.

In the case of 100 copies, however, the expression of (WP1+100CP1)≫(WP2 +100CP2) holds, as shown in FIGS. 1(*c*) and 1(*d*), because 100CP1 becomes extremely longer than 100CP2, and the time required for copying becomes longer extremely, in spite of shortening of WP.

As stated above, any of the conventional technology for shortening a warm-up time is not sufficient, and it has a problem, in particular, that the reduction of the warm-up time desired by a user cannot be attained.

Though a technology to shorten the warm-up time has been developed by an improvement of a fixing device, on the other hand, warm-up time is needed for those other than a specific image forming apparatus such as a small-sized apparatus, and an image forming apparatus having a warm-up time satisfied by a user has not been realized, although a fixing device requiring no warm-up time has been developed in the field of a small-sized apparatus or a low-speed apparatus.

[Patent Document 1] Japanese Patent Open to Public Inspection No. 2003-66765

SUMMARY

An objective of the invention is to provide an image forming apparatus wherein quick output satisfying user's needs is possible when a user desires that a print is outputted within a short period of time after the user presses a copy button, and sufficient fixing ability is secured.

The aforesaid objective is attained by the following invention.

An image forming apparatus having therein an image forming section that forms an image on a recording material and a fixing device that conducts heat fixing of the image on the recording material, wherein there are provided a control section that controls a recording material conveyance speed and controls a warm-up completion temperature in the aforesaid fixing device and a quick output mode setting section wherein a quick output mode to shorten a warm-up time to conduct image forming process is set by user's operations, and the aforesaid control section sets the aforesaid recording material conveyance speed to the first speed at the first warm-up completion temperature when the aforesaid quick output mode is not set by the aforesaid quick output mode setting section, and sets the aforesaid recording material conveyance speed to the second speed that is lower than the first speed at the second warm-up completion temperature that is lower than the first warm-up completion temperature when the aforesaid quick output mode is set by the aforesaid quick output mode setting section.

DETAILED DESCRIPTION OF THE PREFERRED EMBODIMENT

The invention will be described as follows, referring to the following illustrated embodiment, to which, however, the invention is not limited.

<Image Forming Apparatus>

Figure 2:
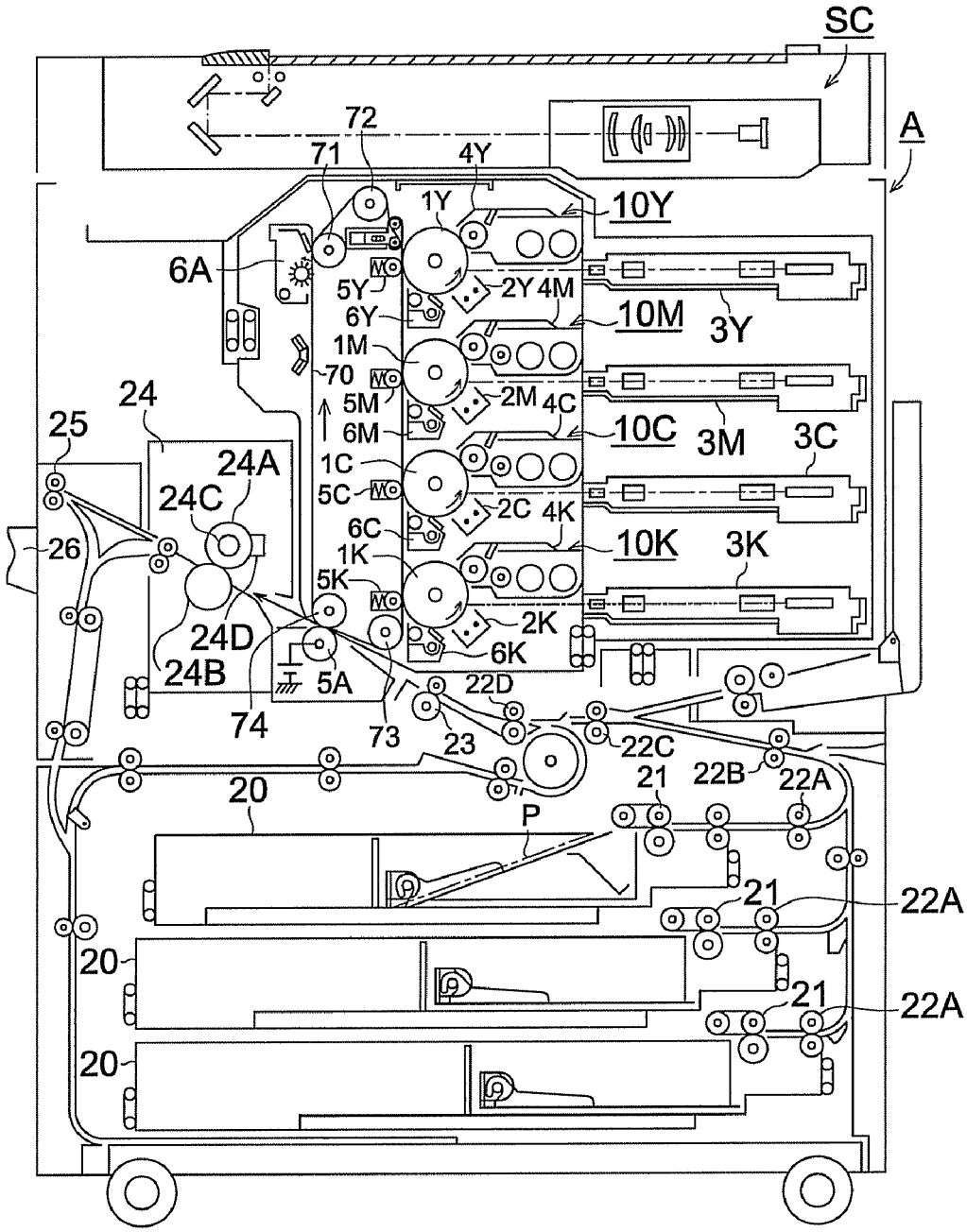
FIG. 2 is a structural diagram of an image forming apparatus relating to the embodiment of the invention.

FIG. 2 is a structural diagram of an image forming apparatus relating to the embodiment of the invention.

Image forming apparatus A is one called a tandem type color image forming apparatus that is composed of plural sets of image forming sections 10Y, 10M, 10C and 10K, belt-shaped intermediate transfer body 70, sheet-feeding section 20 and fixing device 24.

Image reading apparatus SC is installed in the upper portion of image forming apparatus A. Images of a document placed on a document table are subjected to scanning exposure by an optical system of a document image scanning exposure section of the image reading apparatus SC, to be read in a line image sensor. Analog signals converted photoelectrically by the line image sensor are subjected to analog processing, A/D conversion, shading correction and image compression processing in the image processing section, to be inputted in exposure sections 3Y, 3M, 3C and 3K.

An image forming apparatus that forms images on recording material P is composed of image forming sections 10Y, 10M, 10C and 10K, intermediate transfer body 70 and of secondary transfer device 5A.

The image forming section 10Y that forms images in yellow (Y) color has charging unit 2Y, exposure unit 3Y, developing unit 4Y and cleaning unit 6Y which are arranged on a circumference of photoconductor drum 1Y representing an image carrier. The image forming section 10M that forms images in magenta (M) color has photoconductor drum 1M representing an image carrier, charging unit 2M, exposure unit 3M, developing unit 4M and cleaning unit 6M. The image forming section 10C that forms images in cyan (C) color has photoconductor drum 1C representing an image carrier, charging unit 2C, exposure unit 3C, developing unit 4C and cleaning unit 6C. The image forming section 10K that forms images in black (K) color has photoconductor drum 1K representing an image carrier, charging unit 2K, exposure unit 3K, developing unit 4K and cleaning unit 6K.

A latent image forming section is composed of charging unit 2Y and exposure unit 3Y, charging unit 2M and exposure unit 3M, charging unit 2C and exposure unit 3C and of charging unit 2K and exposure unit 3K.

The symbols 4Y, 4M, 4C and 4K represent developing units housing two-component developers which are composed respectively of yellow (Y) small particle size toner and carrier, magenta (M) small particle size toner and carrier, cyan (C) small particle size toner and carrier and black (K) small particle size toner and carrier.

The intermediate transfer body 70 is wound around a plurality of rollers 71-74 to be supported rotatably.

Images in respective colors formed respectively by the image forming sections 10Y, 10M, 10C and 10K are transferred onto rotating intermediate transfer body 70 in sequence respectively by primary transfer devices 5Y, 5M, 5C and 5K, thus, a composite color image is formed.

The image forming sections 1Y, 10M, 10C and 10K, the intermediate transfer body 70 and secondary transfer device 5A constitute an image forming section that forms images on recording material P.

Recording sheet P loaded in sheet-feeding cassette 20 is fed by sheet-feeding section (first sheet-feeding section) 21, and is conveyed to secondary transfer device 5A through sheet-feeding rollers 22A, 22B, 22C and 22D and through registration roller (second sheet-feeding section) 23, thus, a color image is transferred onto recording sheet P.

Incidentally, sheet-feeding cassettes 20 in three stages arranged in the vertical direction below image forming apparatus A are of the same structure substantially, and three sheet-feeding sections 21 are also of the same structure substantially.

In fixing device 24, a color toner image (or a toner image) on recording sheet P receives heat and pressure to be fixed on the recording sheet P, which is interposed between sheet-ejection rollers 25 to be ejected on sheet-ejection tray 26 outside an apparatus.

The fixing device 24 has fixing roller 24A wherein heater 24C composed of a halogen lamp is arranged and has pressure roller 24B that is in pressure contact with the fixing roller 24A, and recording material P is interposed between the fixing roller 24A and pressure roller 24B to be conveyed, and heating during the conveyance makes an unfixed toner image on the recording material P to be fixed.

The symbol 24D represents a temperature sensor that detects a surface temperature of the fixing roller 24A.

On the other hand, cleaning device 6A removes toner remaining on intermediate transfer body 70 from which the recording sheet P is curvature-separated after a color image is transferred onto the recording sheet P by secondary transfer device 5A.

The intermediate transfer body 70 is wound around a plurality of rollers 71-74 to conduct cyclic movement in the direction of the arrow.

Figure 3:
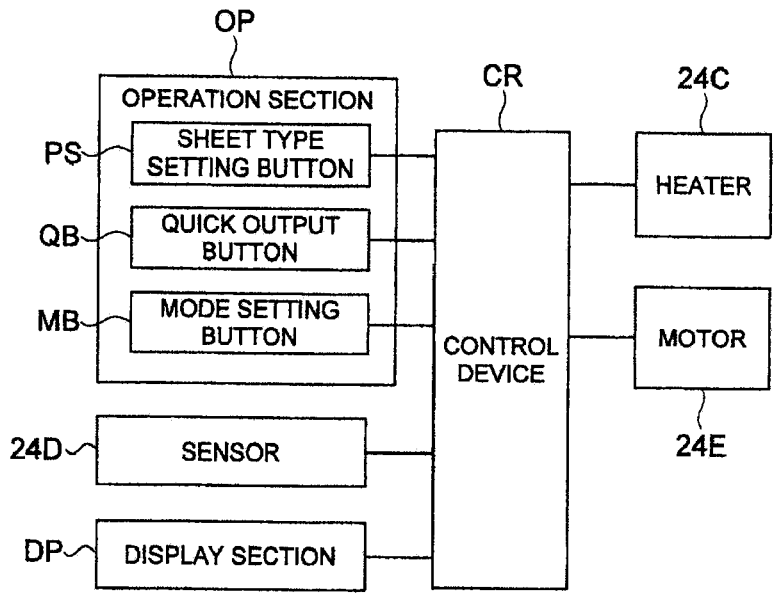
FIG. 3 is a block diagram of a control system of the image forming apparatus shown in FIG. 1.

FIG. 3 is a block diagram of a control system of the image forming apparatus shown in FIG. 2.

The symbol OP represents an operation display section, and it has sheet type setting button PS representing a recording material type setting section that can set the sheet type by distinguishing types of recording materials, for example, by distinguishing regular paper from thick paper which is thicker than regular paper, quick output button QB representing a quick output setting section and image forming mode setting button MB representing a mode setting section.

The quick output setting button QB is a button that is operated when a user desires quick output, that is, desires that a print is finished within a short period of time after a copy button is pressed.

The symbol 24D represents a temperature sensor that detects a surface temperature of the fixing roller 24A as shown in FIG. 2, and it is composed of a thermistor.

The symbol 24C represents a heater that is arranged inside fixing roller 24A and heats fixing roller 24A up to the temperature capable of fixing as shown in FIG. 2, and 24E represents a motor that drives the fixing roller 24A.

Control section CR controls heater 24C and motor 24E based on signals from recording material type setting section PS, quick output button QB, image forming mode setting button MB and temperature sensor 24D, as described later.

In the image forming, control section CR operates motor 24E at a prescribed speed based on setting information in sheet type setting button PS and in image forming mode setting button MB, and controls a surface temperature of fixing roller 24A to be a prescribed fixing temperature based on output of temperature sensor 24D, to fix a toner image.

<Fixing Control>

Relations for a surface temperature (hereinafter referred to as fixing temperature) of fixing roller 24A in fixing device 24, a conveyance speed (hereinafter referred to as fixing speed) for recording material in fixing device 24, types (hereinafter referred to as sheet types) of recording materials and monochrome mode/color mode are shown in Table 1.

TABLE 1

| Fixing temperature | Regular paper Linear speed | | Thick paper Linear speed | |
|---|---|---|---|---|
| | Monochrome image | Color image | Monochrome image | Color image |
| 140° C.- | 125 mm/s | — | — | — |
| 150° C.- | 140 mm/s | 125 mm/s | — | — |
| 160° C.- | 250 mm/s | 140 mm/s | 125 mm/s | — |
| 170° C.- | 300 mm/s | 250 mm/s | 140 mm/s | 125 mm/s |

Relations shown in Table 1 are as follows qualitatively.

When the conveyance speed is made to be lower, a lower limit of the fixing temperature, namely, a fixing-feasible temperature is made to be lower. In the case of a color mode, a fixing-feasible temperature needs to be higher because the amount of heat necessary for fixing is larger than in the case of a monochrome mode. Thus, it is necessary to lower the conveyance speed for lowering the fixing-feasible temperature. Further, in the case of thick paper, the amount of heat necessary for fixing is larger than that for regular paper, therefore, the fixing-feasible temperature is made to be higher and the fixing speed needs to be lowered.

When the fixing-feasible temperature is lower, the warm-up time required for enhancing the fixing temperature up to the fixing-feasible temperature through heating is shortened.

The fixing-feasible temperature is a target temperature for finishing a warm-up when conducting a warm-up. To be more specific, when the fixing temperature arrives at the fixing-feasible temperature, the warm-up is finished, and concurrently with a termination of the warm-up, image forming turns out to be possible.

Therefore, in the following explanation, the fixing-feasible temperature is called also a warm-up completion temperature.

In the invention, excellent fixing can be secured by satisfying the conditions shown in Table 1 and described above, and there has been realized an image forming apparatus that operates at high efficiency desired by a user and outputs stably images with high image quality, by providing a quick output mode that shortens a warm-up time.

Control of fixing in each embodiment will be described as follows.

In the following explanation, warm-up completion temperatures t1-t4 and fixing speeds v1-v4 correspond to Table 1, and they have the following values; t1: 140° C., t2: 150° C., t3: 160° C. and t4: 170° C. and v1: 125 mm/s, v2: 140 mm/s, v3: 250 mm/s and v4: 300 mm/s.

For example, in the case of a monochrome mode wherein regular paper is used and a fixing speed is made to be 125 mm/s, the fixing-feasible temperature is 140° C.

Figure 4:
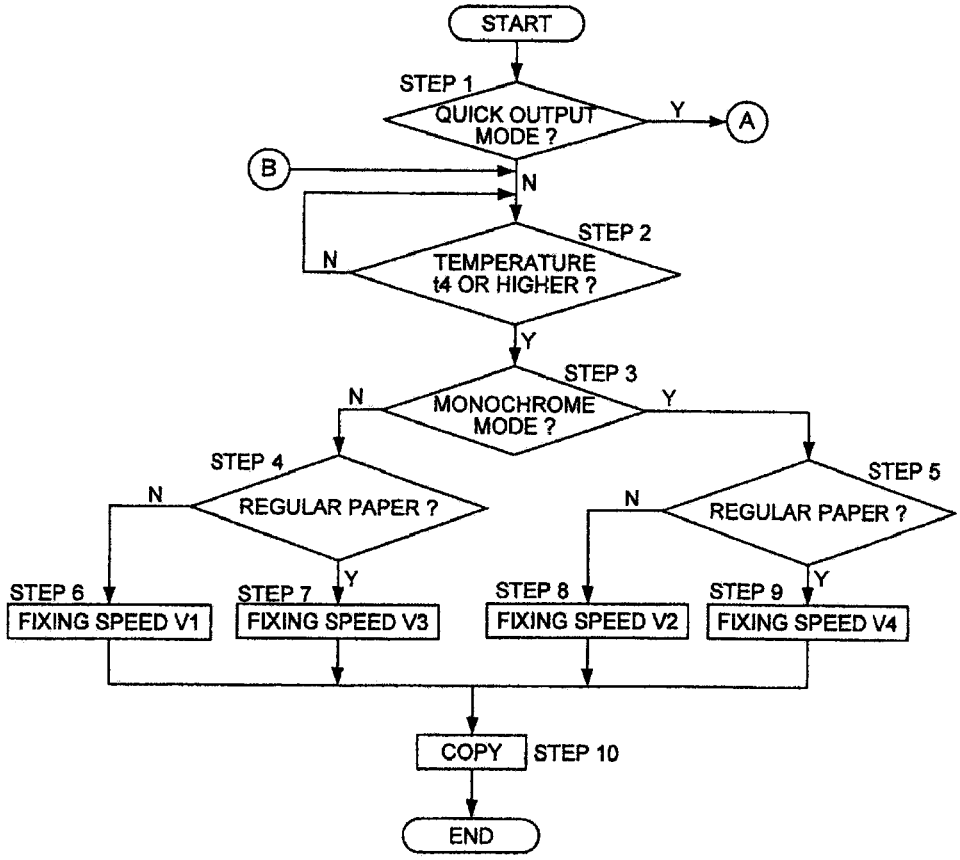
FIG. 4 is a flow chart of a fixing control in each of Embodiments 1-4 of the invention.
Figure 5:
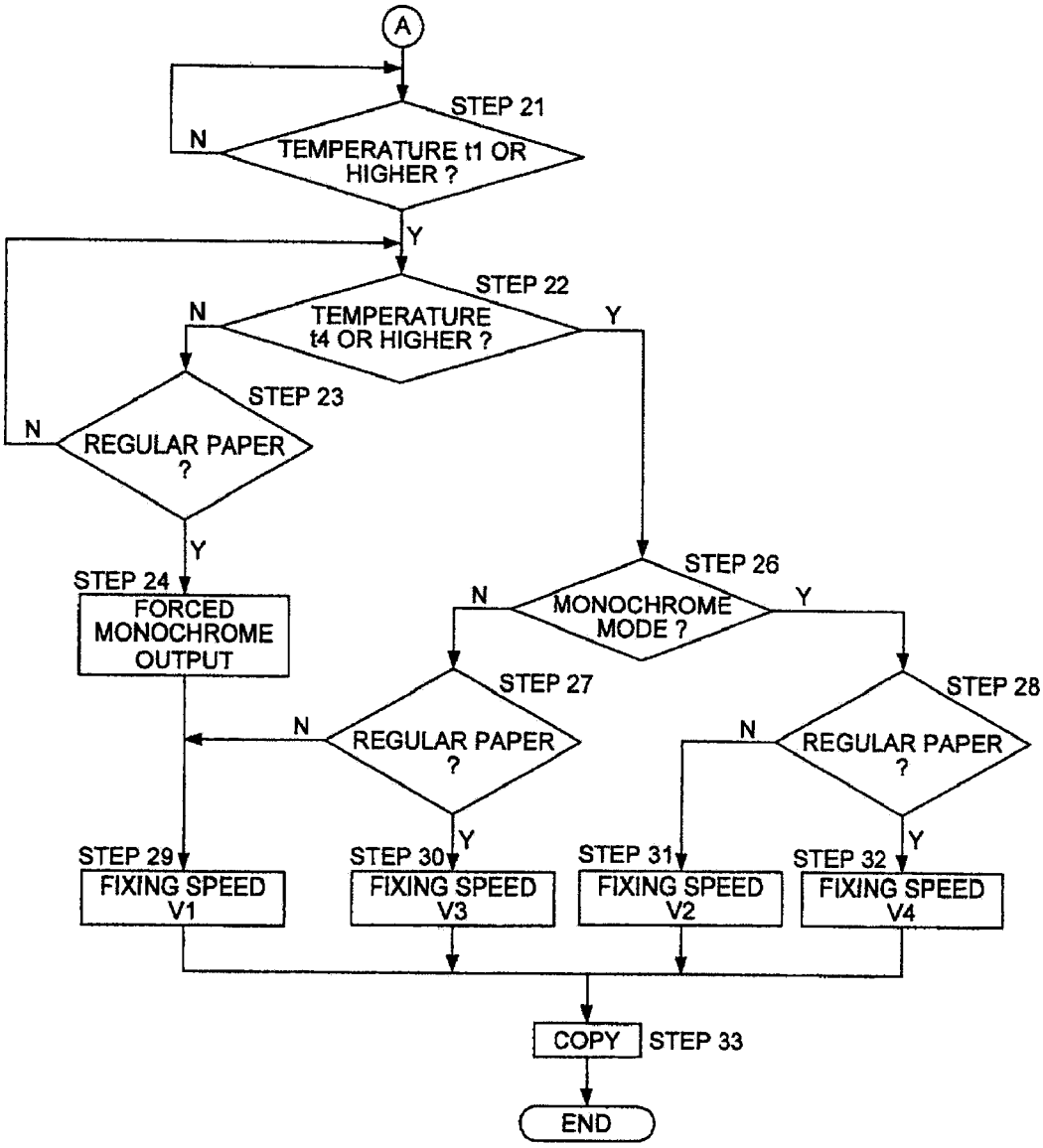
FIG. 5 is a flow chart of a fixing control in Embodiment 1 of the invention.

Each of FIG. 4 and FIG. 5 is a flow chart of a fixing control to control warm-up completion temperatures and fixing speeds in Embodiment 1 of the invention.

In fixing control, in the case of an ordinary mode where a quick output mode is not set, recording material conveyance speed is set to the first speed at the first warm-up completion temperature, as described below. Further, when the quick output mode is set, the aforesaid recording material conveyance speed is set to the second speed that is lower than the first speed, at the second warm-up completion temperature that is lower than the first warm-up completion temperature.

Owing to this, the warm-up time in the quick output mode is shortened.

For securing appropriate fixing performance, the fixing speed is set to the appropriate value, relating to a warm-up completion temperature, types of recording materials and distinction of a monochrome mode and a color mode. Total operations speeds in the image forming apparatus, namely, linear speeds respectively for photoconductor drums 1Y, 1M, 1C and 1K, linear speeds of developing sleeves in developing units 4Y, 4M, 4C and 4K, a linear speed of intermediate transfer body 70 and a conveyance speed for recording material are set corresponding to the selected fixing speed. The operation speeds of the total image forming apparatus of this kind are called process speeds.

The fixing control is started by power-on. This power-on represents power activation for a main switch or a return to an operation mode from a power-saving mode.

Heater 24C of a fixing device is turned on by the power-on to start heating, and a period from this moment to the moment to arrive at the fixing-feasible temperature is warm-up time.

In STEP 1, a judgment is made whether a mode is a quick output mode or not. The symbol Y represents an occasion when a quick output mode button is pressed by an operator, and the symbol N represents an occasion when a quick output mode button is not pressed. The control in the case of N in a judgment in STEP 1 is shown in FIG. 4.

When the judgment of quick output mode is N, the process advances to STEP 2-STEP 10, and when the quick output mode is Y, the process advances to STEP 21-STEP 33.

In STEP 2, the fixing temperature is judged whether it has arrived at warm-up completion temperature t4 or not, and the warm-up is continued until the fixing temperature arrives at warm-up completion temperature t4.

At the moment when the fixing temperature arrives at warm-up completion temperature t4 (Y in STEP2), a mode is judged whether it is a monochrome mode or not (STEP3).

When the mode is not a monochrome mode, that is, the mode is a color mode, a recording material used in STEP 4 is judged whether it is regular paper or not.

When it is not regular paper, that is, when it is thick paper (N in STEP 4), fixing speed v1 is selected (STEP 6).

When it is regular paper (Y in STEP 4), fixing speed v3 (STEP 7) is selected.

When the mode is judged to be monochrome mode in the judgment in STEP 3, a sheet is judged whether it is regular paper or not in STEP 5.

When the sheet is judged not to be regular paper (N in STEP 5) in the judgment in STEP 5, fixing speed v2 is selected (STEP 8).

When the sheet is judged to be regular paper (Y in STEP 5) in the judgment in STEP 5, fixing speed v4 (STEP 9) is selected.

In STEP 10, the fixing speed thus selected is used for copying.

When a judgment for the quick output mode is Y (Y in STEP 1), the fixing temperature is judged whether it is less than warm-up completion temperature t1 or not, in STEP 21 in FIG. 5.

At a step when the fixing temperature arrives at the warm-up completion temperature t1, the fixing temperature is judged whether it has arrived at warm-up completion temperature t4 or not (STEP 22).

When the fixing temperature has not arrived at the warm-up completion temperature t4, a sheet is judged whether it is regular paper or not in STEP 23.

When the sheet is judged to be regular paper (Y in STEP 23), monochrome image output is set in STEP 24.

In the present embodiment, an apparatus is constructed so that monochrome printing is conducted in the quick output mode. Accordingly, cautions to the effect that "In the quick output mode, monochrome copying or monochrome printing only is conducted. Therefore, a quick output button should not be used when color copying or color printing is desired." are shown on a display or on a user manual.

In the present embodiment, therefore, monochrome images are outputted in the quick output mode, even in the case of copies or prints based on color image data.

Next, in STEP 29, fixing speed v1 is selected.

When the sheet is judged not to be regular paper (N in STEP 23) in the judgment in STEP 23, the process returns to STEP 22, and the fixing temperature is judged whether it is less than warm-up completion temperature t4 or not.

At a step when the fixing temperature arrives at the warm-up completion temperature t4, a mode is judged whether it is a monochrome mode or not at STEP 26.

From STEP 26 up to STEP 32, the control is the same as that in FIG. 4 where the quick output button is not pressed.

In the control for STEP 26 and thereafter, respective steps in FIG. 4 and FIG. 5 correspond as in STEP 3-STEP 26, STEP 4-STEP 27, STEP 5-STEP 28, STEP 6-STEP 29, STEP 7-STEP 30, STEP 8-STEP 31 and STEP 9-STEP 32, and establishments of fixing speeds v1-v4 like those described above are conducted.

Next, in STEP 33, copying is conducted.

Figure 6:
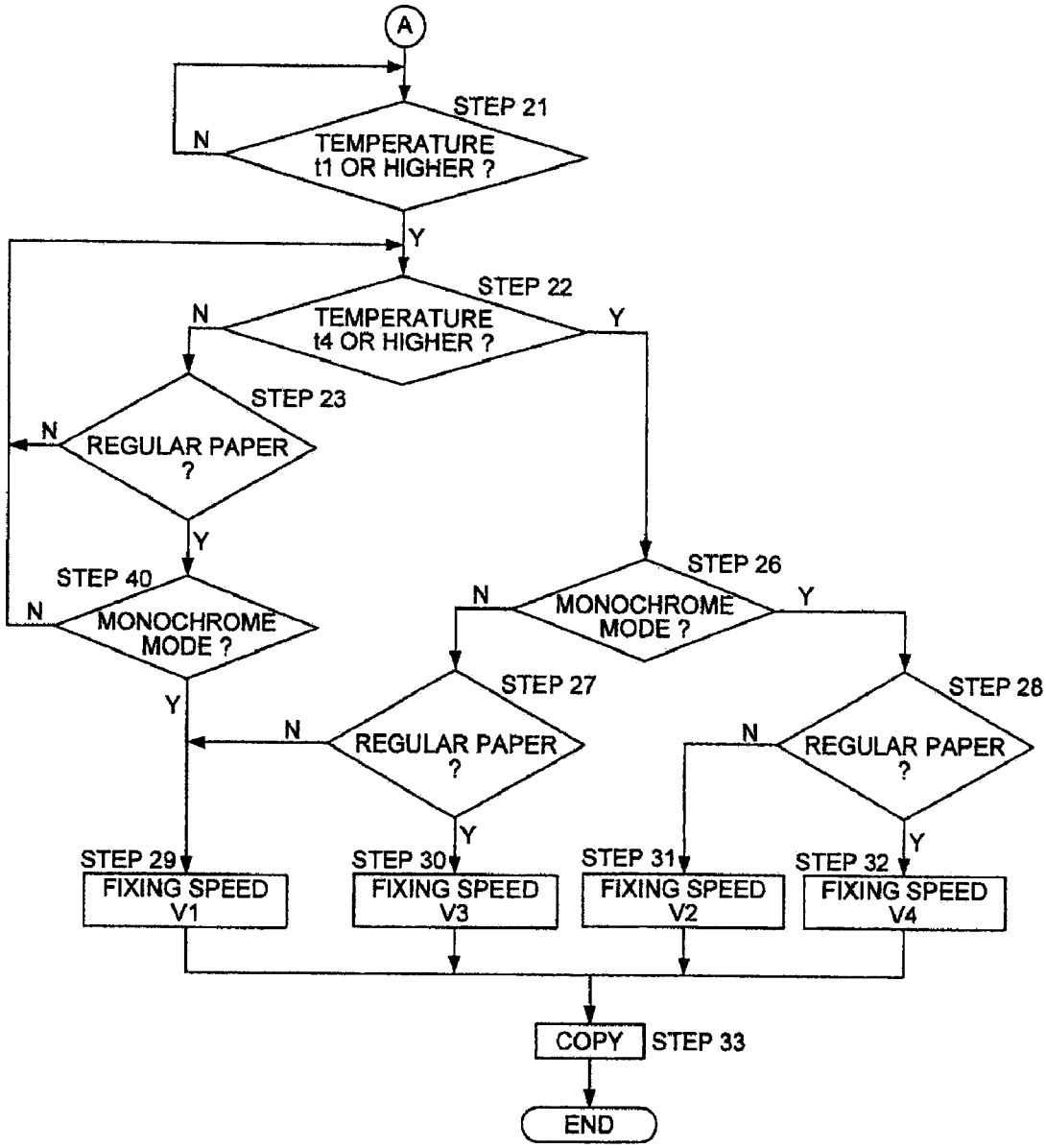
FIG. 6 is a flow chart of a fixing control in Embodiment 2 of the invention.

FIG. 6 is a flow chart of fixing control in Embodiment 2 of the invention.

In the present embodiment, the control where a quick output button is not pressed is the same as that shown in FIG. 4.

When the quick output button is pressed, the control up to STEP 22 is the same as that in Embodiment 1, and in the present embodiment, when the fixing temperature is judged not to have arrived at warm-up completion temperature t4 in the judgment at STEP 22, the sheet is judged whether it is regular paper or not in STEP 23.

When the sheet is judged not to be regular paper in the judgment in STEP 23, the process returns to STEP 22, while when the sheet is regular paper, the mode is judged whether it is a monochrome mode or not, in STEP 40.

When the mode is judged to be a monochrome mode in STEP 40, fixing speed v1 is selected (STEP 29), and when it is not a monochrome mode, the process returns to STEP 22.

The present embodiment is the same as Embodiment 1 shown in FIG. 5, except for STEP 23 and STEP 40.

Each of STEP 23 and STEP 40 is a step for pressing a quick output button, selecting a monochrome mode, functioning only when using regular paper, and practicing the fixing control to start image forming after waiting the fixing temperature to rise to the necessary temperature, when a color mode is set and thick paper is used despite pressing of a quick output button.

Figure 7:
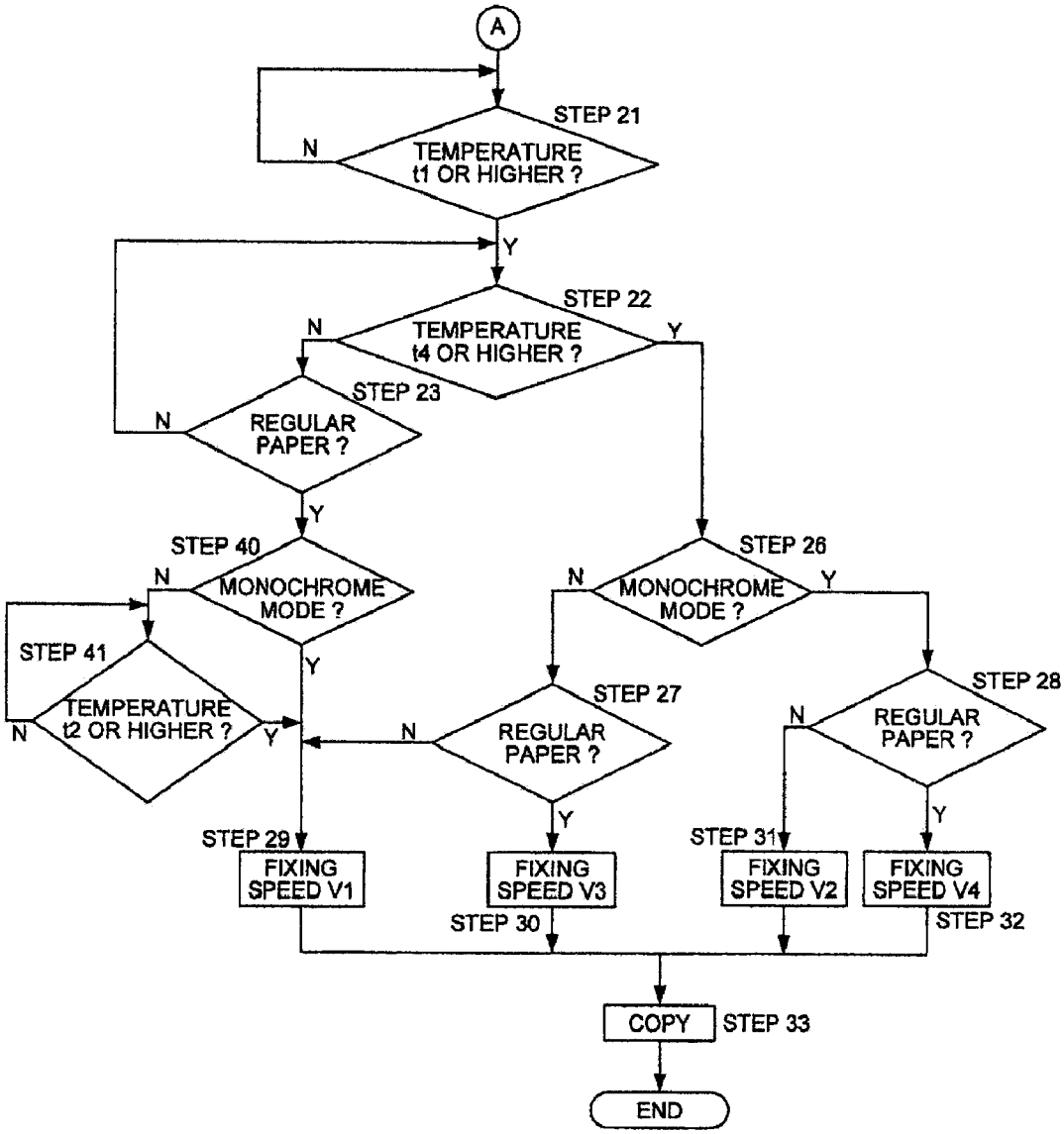
FIG. 7 is a flow chart of a fixing control in Embodiment 3 of the invention.

FIG. 7 is a flow chart of fixing control in Embodiment 3 of the invention.

In the present embodiment, the control where a quick output button is not pressed is the same as that shown in FIG. 4.

Steps up to STEP 23 in fixing control of the present embodiment are the same as those in Embodiment 2 shown in FIG. 6.

When a mode is judged not to be a monochrome mode in the judgment in STEP 40 that follows STEP 23, the fixing temperature is waited until it rises to warm-up completion temperature t2 or higher in STEP 41.

At the step where the fixing temperature has been enhanced to warm-up completion temperature t2 or higher in STEP 41, fixing speed v1 is selected in STEP 29.

In the present embodiment, even in the case of a color mode, quick output image forming is conducted in the case of copying or printing using regular paper.

To be more specific, by causing the fixing speed to be 125 mm/sec under the conditions of a quick output mode, using a regular paper and in a color mode, fixing at fixing temperature 150° C. that is lower than 170° C. is possible, thus, a warm-up time is shortened by an amount equivalent to a reduction of the fixing temperature.

Figure 8:
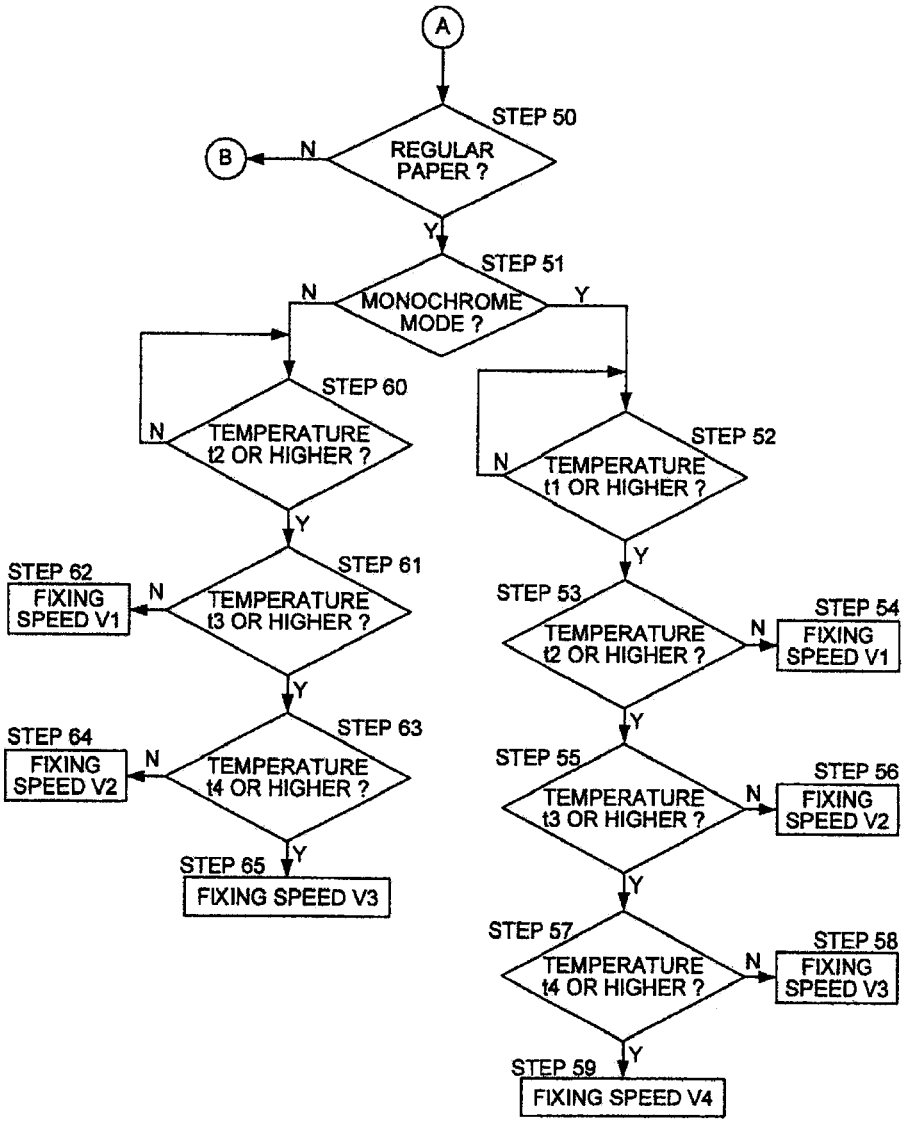
FIG. 8 is a flow chart of a fixing control in Embodiment 4 of the invention.

FIG. 8 is a flow chart of fixing control in Embodiment 4 of the invention.

In the present embodiment, the control where a quick output button is not pressed is the same as that shown in FIG. 4.

In the case of the quick output mode (Y in STEP 1 in FIG. 4), a sheet is judged whether it is regular paper or not in STEP 50.

When it is not regular paper (N in STEP 50), the process moves to STEP 2 in FIG. 4, and controls for STEP 2 and thereafter are conducted.

In the controls for STEP 2 and thereafter, fixing speed v1 or v2 applied to those other than regular paper is selected, as is apparent from FIG. 4 and Table 1, and neither v3 nor v4 is selected.

In the case of regular paper, a mode is judged whether it is a monochrome mode or not in STEP 51.

When the mode is judged to be the monochrome mode, the fixing temperature is waited until it rises to warm-up completion temperature t1 (loop in STEP 52).

When the fixing temperature is warm-up completion temperature t1 or higher and is lower than warm-up completion temperature t2 (Y in STEP 52 and N in STEP 53), fixing speed v1 is selected (STEP 54).

When the fixing temperature is warm-up completion temperature t2 or higher and is lower than warm-up completion temperature t3 (Y in STEP 53 and N in STEP 55), fixing speed v2 is selected (STEP 56), when the fixing temperature is warm-up completion temperature t3 or higher and is lower than warm-up completion temperature t4 (Y in STEP 55 and N in STEP 57), fixing speed v3 is selected (STEP 58) and when the fixing temperature is warm-up completion temperature t4 or higher (Y in STEP 57), fixing speed v4 is selected (STEP 59).

When the mode is judged not to be a monochrome mode in STEP 51, the fixing temperature is waited until it rises up to warm-up completion temperature t2 or higher (loop in STEP 60).

When the fixing temperature is warm-up completion temperature t2 or higher and is lower than warm-up completion temperature t3 (Y in STEP 60 and N in STEP 61), fixing speed v1 is selected (STEP 62).

When the fixing temperature is warm-up completion temperature t3 or higher and is lower than warm-up completion temperature t4 (Y in STEP 61 and N in STEP 63), fixing speed v2 is selected (STEP 64), and when the fixing temperature is warm-up completion temperature t4 or higher (Y in STEP 63), fixing speed v3 is selected (STEP 65).

As is apparent from Table 1, when thick paper is used, a lowering in a fixing temperature is small, and thereby, an effect of shortening of warm-up time obtained by the lowering in the fixing temperature is small.

In the fixing control in FIG. 8, a quick output mode is eliminated when thick paper is used, and fixing speed is controlled finely for each of a monochrome mode and a color mode when regular paper is used, thus, a warm-up time is shortened as far as possible to shorten waiting time.

As stated above, the fixing controls are different from each other depending on user's setting of quick output mode, and establishment of a guidance concerning setting of quick output mode is user-friendly, which is preferable.

The guidance of this kind is shown on display section DP shown in FIG. 3.

Figure 9:
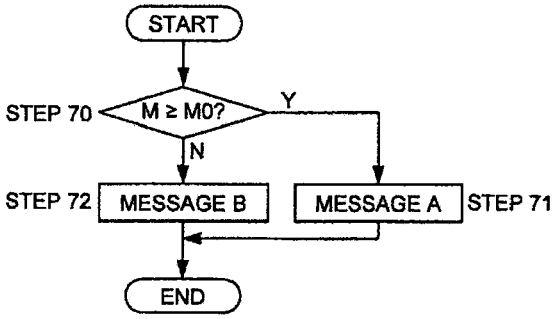
FIG. 9 is a flow chart of a guidance for quick output setting.

FIG. 9 is a flow chart of the guidance.

The symbol M in STEP 70 represents the number of sets of copies.

Figure 1:
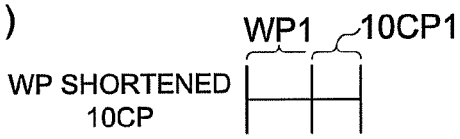
FIGS. 1(*a*), 1(*b*), 1(*c*) and 1(*d*) are diagrams each showing a comparison of copying time between a warm-up shortened mode and a warm-up regular mode.
Figure 1:
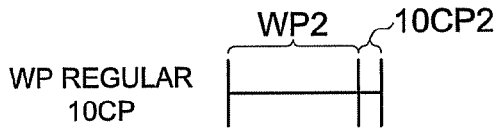
Figure 1:
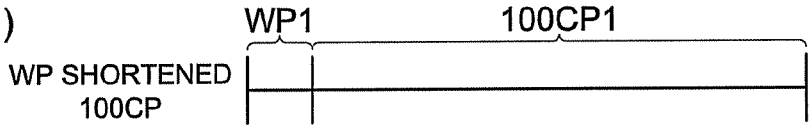
Figure 1:
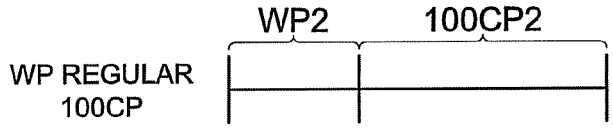

As described above using FIG. 1, when the number of copies is large, an increase of copying time caused by slow down of the speed exceeds a reduction of warm-up time caused by a drop in the fixing temperature, resulting in an increase of copying time.

The symbol MO represents a marginal number of sheets concerning reduction effects wherein an increase of time caused by a slowdown of the speed exceeds a reduction of a warm-up time.

In STEP 70, when M≧MO holds (Y in STEP 70), message A such as "Completion of copy will be delayed.", for example, is displayed on display section DP in STEP 71.

In the case of the number of copies M<M0, copy completion time is determined by the number of sets of copies and by the number of documents.

Therefore, in STEP 72, message B of the guidance is displayed based on the number of copies and the number of documents.

For example, the message B is as follows.

When a user sets the number of copies to be N, comments such as "Copy completion will be delayed when the number of documents is MO/N or more" are message B.

By counting the number of documents, a user can judge whether the number of copies that is the product of the number of documents multiplied by the number of sets of copies is less than marginal number of sheets MO or not.

When a user presses a quick output button after observing the message displayed on display section DP, efficient copying is made possible.

What is claimed is:

1. An image forming apparatus comprising:

an image forming section for forming an image on a recording material;

a fixing device for conducting heat fixing of the image formed on the recording material;

a control section for controlling a recording material conveyance speed and a warm-up completion temperature in the fixing device;

a quick output mode setting section for setting a quick output mode by a user's operation to shorten a warm-up time for conducting image forming; and a recording material setting section for setting a type of the recording material;

wherein the control section sets the recording material conveyance speed to be a first speed at a first warm-up completion temperature when the quick output mode is not set by the quick output mode setting section;

wherein when the quick output mode is set, the control section sets the recording material conveyance speed to be a second speed, which is slower than the first speed, at a second warm-up completion temperature which is lower than the first warm-up completion temperature; and wherein the control section controls the warm-up completion temperature according to the type of the recording material set by the recording material setting section and the quick output mode setting section sets the quick output mode only when the recording material setting section sets a regular sheet.

2. The image forming apparatus of claim 1, wherein when the recording material setting section sets a thick sheet, the control section sets the warm-up completion temperature higher than a warm-up completion temperature set at a time when a regular sheet is set.

3. The image forming apparatus of claim 1, wherein when the recording material setting section sets a thick sheet, the control section sets the recording material conveyance speed slower than a recording material conveyance speed set at a time when a regular sheet is set.

4. The image forming apparatus of claim 1, further comprising:

an image forming mode setting section for setting a monochrome mode or a color mode, wherein when the monochrome mode is set, the control section sets the warm-up completion temperature lower than a warm-up completion temperature set at a time when the color mode is set.

5. The image forming apparatus of claim 1, wherein when the quick output mode is set, the control section performs image forming for forming a monochrome image.

6. The image forming apparatus of claim 1, wherein when the quick output mode is set by the quick output mode setting section during a warm-up, the control section switches to a control of the warm-up completion temperature of the quick output mode.

7. An image forming apparatus comprising:

an image forming section for forming an image on a recording material;

a fixing device for conducting heat fixing of the image formed on the recording material:

a control section for controlling a recording material conveyance speed and a warm-up completion temperature in the fixing device;

a quick output mode setting section for setting a quick output mode by a user's operation to shorten a warm-up time for conducting image forming; and a display section for conducting display related to comparison between a length of time for image forming in the quick output mode and a length of time for image forming in a regular mode;

wherein the control section sets the recording material conveyance speed to be a first speed at a first warm-up completion temperature when the quick output mode is not set by the quick output mode setting section; and wherein when the quick output mode is set, the control section sets the recording material conveyance speed to be a second speed, which is slower than the first speed, at a second warm-up completion temperature which is lower than the first warm-up completion temperature.

8. The image forming apparatus of claim 7, further comprising:

a recording material setting section for setting a type of the recording material, wherein the control section controls the warm-up completion temperature according to the type of the recording material set by the recording material setting section.

9. The image forming apparatus of claim 8, wherein when the recording material setting section sets a thick sheet, the control section sets the warm-up completion temperature higher than a warm-up completion temperature set at a time when a regular sheet is set.

10. The image forming apparatus of claim 8, wherein when the recording material setting section sets a thick sheet, the control section sets the recording material conveyance speed slower than a recording material conveyance speed set at a time when a regular sheet is set.

11. The image forming apparatus of claim 8, wherein the quick output mode setting section sets the quick output mode only when the recording material setting section sets a regular sheet.

12. The image forming apparatus of claim 7, further comprising:

an image forming mode setting section for setting a monochrome mode or a color mode, wherein when the monochrome mode is set, the control section sets the warm-up completion temperature lower than a warm-up completion temperature set at a time when the color mode is set.

13. The image forming apparatus of claim 7, wherein when the quick output mode is set, the control section performs image forming for forming a monochrome image.

14. The image forming apparatus of claim 7, wherein when the quick output mode is set by the quick output mode setting section during a warm-up, the control section switches to a control of the warm-up completion temperature of the quick output mode.

* * * * *